US009500979B2

(12) United States Patent
Takarada

(10) Patent No.: US 9,500,979 B2
(45) Date of Patent: Nov. 22, 2016

(54) CARTRIDGE AND IMAGE FORMING APPARATUS

(71) Applicant: CANON KABUSHIKI KAISHA, Tokyo (JP)

(72) Inventor: Hiroshi Takarada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/016,897

(22) Filed: Sep. 3, 2013

(65) Prior Publication Data

US 2014/0064785 A1 Mar. 6, 2014

(30) Foreign Application Priority Data

Sep. 5, 2012 (JP) ..... 2012-194870

(51) Int. Cl.

| | |
|---|---|
| ***G03G 15/00*** | (2006.01) |
| ***G03G 15/02*** | (2006.01) |
| ***G03G 21/00*** | (2006.01) |
| ***G03G 21/16*** | (2006.01) |
| *G03G 21/18* | (2006.01) |

(52) U.S. Cl.

CPC ..... *G03G 15/0283* (2013.01); *G03G 15/80* (2013.01); *G03G 21/0023* (2013.01); *G03G 21/1652* (2013.01); *G03G 21/181* (2013.01)

(58) Field of Classification Search

CPC ..... G03G 15/0283; G03G 15/80; G03G 21/0023; G03G 21/1652; G03G 21/181

USPC ..... 399/90, 111, 351

See application file for complete search history.

(56) References Cited

U.S. PATENT DOCUMENTS

| | | | | |
|---|---|---|---|---|
| 2009/0245851 | A1* | 10/2009 | Hoshi et al. | 399/103 |
| 2013/0022368 | A1* | 1/2013 | Takarada et al. | 399/110 |
| 2013/0114972 | A1* | 5/2013 | Takarada et al. | 399/110 |
| 2013/0121720 | A1* | 5/2013 | Hoshi et al. | 399/106 |
| 2013/0170851 | A1* | 7/2013 | Takarada et al. | 399/90 |

FOREIGN PATENT DOCUMENTS

| | | | | |
|---|---|---|---|---|
| JP | 2001-030297 | A | 2/2001 | |
| JP | 2002-086573 | A | 3/2002 | |
| JP | 2003-191289 | A | 7/2003 | |
| JP | 2009265612 | A | 11/2009 | |
| JP | 2012-063750 | A | 3/2012 | |
| JP | 2012063750 | A * | 3/2012 | G03G 21/18 |

* cited by examiner

*Primary Examiner* — Benjamin Schmitt

(74) *Attorney, Agent, or Firm* — Canon U.S.A., Inc. IP Division

(57) ABSTRACT

In a configuration in which a charging roller contact unit of a contact unit is located in a periphery of a mounting surface for mounting a cleaning blade of a drum cartridge frame, at least a part of the charging roller contact unit of the contact unit is formed in such a manner that an area of a cross section perpendicular to a direction approaching to the mounting surface of the cleaning blade becomes smaller with an approach to the mounting surface of the cleaning blade.

14 Claims, 29 Drawing Sheets

D - D

E - E

F - F

CARTRIDGE AND IMAGE FORMING APPARATUS

BACKGROUND OF THE INVENTION

Field of the Invention

The present disclosure relates to a cartridge which is detachably mounted on a main body of an image forming apparatus and the image forming apparatus.

Description of the Related Art

Conventionally, an electrophotographic image forming apparatus has employed a cartridge method in which a photosensitive member and a process unit are integrated as a cartridge, and the cartridge is configured to be detachably mounted on a main body of the image forming apparatus.

In such a cartridge method, a main body electrode of the main body of the image forming apparatus and an electrical contact unit of the cartridge contact with each other in a state that the cartridge is mounted on the main body of the image forming apparatus, and a conducted member (a power-supplied member) of the photosensitive member, the process unit, and the like is electrically connected to the main body of the image forming apparatus. Accordingly, processes for charging the photosensitive member or a developer bearing member, the ground connection of the photosensitive member, detection of a toner remaining amount utilizing capacitance measurement, and the like can be implemented.

As an example of the electrical contact unit of the cartridge, an electrical contact unit is known which is integrally formed with a frame by filling a gap between the frame and a mold closely contacted with the frame with a conductive molten resin (see Japanese Patent Application Laid-Open No. 2012-63750).

However, in the above conventional example, if a supporting portion of the process unit, such as a seating surface of a cleaning blade or a supporting portion of the photosensitive member, is present near an injection part of the molten resin, the following case is concerned. More specifically, in such a case, the heat of the injected resin is transferred to the supporting portion and the periphery of the supporting portion, and the supporting portion and the periphery of the supporting portion may expand with the heat. If the process unit is assembled in a thermally-expanded state, a positional relationship and a form thereof may be affected after it is naturally cooled.

Therefore, the conventional example is required to leave the process unit for a certain period after the injection of the molten resin before assembly, or to forcibly cool down the supporting portion before assembly.

SUMMARY OF THE INVENTION

The present disclosure is directed to, in a configuration which is integrally formed by injecting a molten resin to a frame and has an injection part of the molten resin located in a periphery of a supporting portion of a process unit in the frame, suppression of transfer of heat of the injected molten resin to the supporting portion of the process unit.

According to an aspect of the present disclosure, a cartridge to be detachably mounted to an apparatus main body of an image forming apparatus includes a frame, a process unit configured to perform image forming, a supporting portion which is disposed on the frame and configured to support the process unit, and an injection member which is integrally formed with the frame in such a manner that a molten resin is injected from an injection port disposed on the frame, and an area of a cross section perpendicular to an injection direction approaching from the injection port to the supporting portion is formed to become smaller continuously or in a step-by-step manner with an approach to the supporting portion.

According to another aspect of the present disclosure, a cartridge to be detachably mounted to an apparatus main body of an image forming apparatus includes a frame, a process unit configured to perform image forming, a supporting portion which is disposed on the frame and configured to support the process unit, and an injection member which is integrally formed with the frame in such a manner that a molten resin is injected from an injection port disposed on the frame, and a contact area between the injection member and the frame is formed to become smaller continuously or in a step-by-step manner with an approach from the injection port to the supporting portion.

According to yet another aspect of the present disclosure, an image forming apparatus capable of forming an image on a recording medium includes a frame, a process unit configured to perform image forming, a supporting portion which is disposed on the frame and configured to support the process unit, and an injection member which is integrally formed with the frame in such a manner that a molten resin is injected from an injection port disposed on the frame, and an area of a cross section perpendicular to an injection direction approaching from the injection port to the supporting portion is formed to become smaller continuously or in a step-by-step manner with an approach to the supporting portion.

According to yet another aspect of the present disclosure, an image forming apparatus capable of forming an image on a recording medium includes a frame, a process unit configured to perform image forming, a supporting portion which is disposed on the frame and configured to support the process unit, and an injection member which is integrally formed with the frame in such a manner that a molten resin is injected from an injection port disposed on the frame, and a contact area between the injection member and the frame is formed to become smaller continuously or in a step-by-step manner with an approach from the injection port to the supporting portion.

Further features of the present invention will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. Dimensions, materials, and shapes of components described in the exemplary embodiments and their relative positions are to be changed depending on a configuration of an apparatus to which the present disclosure is applied or various conditions if necessary and thus, if not specifically mentioned, the scope of the present invention is not limited only to such dimensions, materials, and shapes or relative positions.

An electrophotographic image forming apparatus (hereinbelow, referred to as an image forming apparatus) according to a first exemplary embodiment is described below. In the following descriptions, among structural members of the image forming apparatus, configurations of a process cartridge, a drum cartridge, and an electrical contact unit (hereinbelow, referred to as a contact unit) of the drum cartridge, and a forming method are described especially in details. Here, an injection member means a member which is formed by injecting an elastomer or a conductive resin into a frame or a bearing member (according to the present exemplary embodiment, the electrical contact unit which is formed by injecting a conductive the molten resin into a frame is described).

(1) Image Forming Apparatus

Figure 2A:
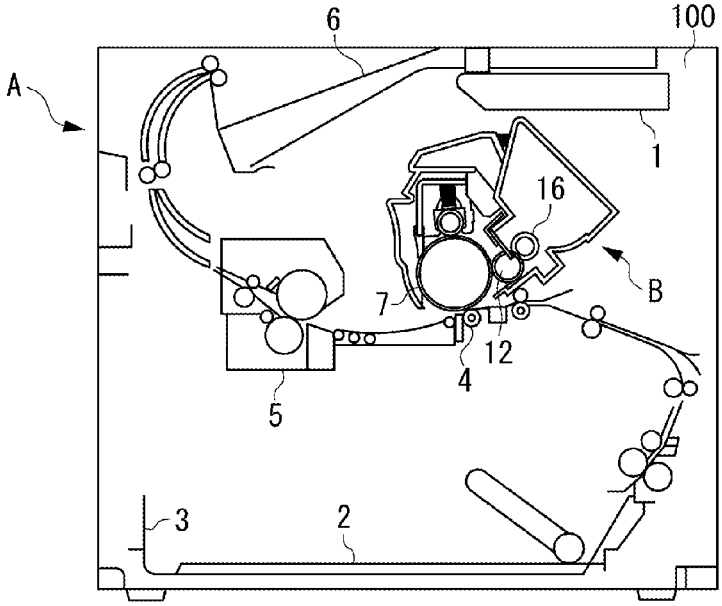
FIGS. 2A and 2B are schematic cross sectional views of an image forming apparatus and a process cartridge according to the first exemplary embodiment.
Figure 2B:
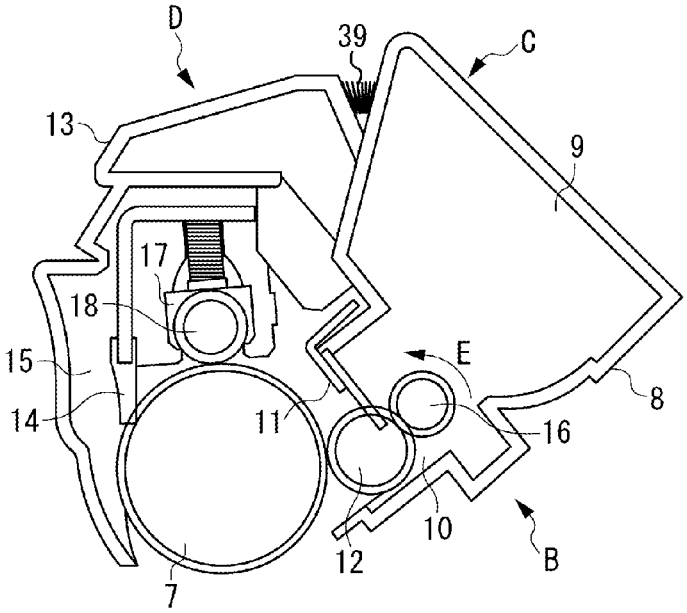

An image forming apparatus A according to the present exemplary embodiment is described with reference to FIGS. 2A and 2B. FIG. 2A is a cross sectional view illustrating a general configuration of the image forming apparatus (a laser beam printer) A in which a process cartridge B is mounted.

In the image forming apparatus A illustrated in FIG. 2A, an image is formed on a recording material 2 as follows. First, an optical system 1 emits information light beams (laser beams) based on image information to an electrophotographic photosensitive member (hereinbelow, referred to as a photosensitive member) 7, an electrostatic latent image is formed on the photosensitive member 7, and then the electrostatic latent image is developed by a developer (hereinbelow, referred to as toner) and formed as a toner image. In synchronization with forming of the toner image, the recording material 2 is conveyed from a sheet feeding cassette 3, and the toner image formed on the photosensitive member 7 is transferred to the recording material 2 by a transfer roller 4. The toner image transferred on the recording material 2 is fixed to the recording material 2 by heat and pressure applied from a fixing unit 5. Then the recording material 2 is discharged to a discharge unit 6.

(2) Process Cartridge

Next, the process cartridge B is described with reference to FIGS. 2A and 2B. FIG. 2B is a cross sectional view illustrating a general configuration of the process cartridge B according to the present exemplary embodiment.

The process cartridge B is formed by a development cartridge C and a drum cartridge D which are connected with each other in a relatively rotatable manner, and detachably mounted to an apparatus main body 100 of the image forming apparatus A.

The development cartridge C includes a development unit and a development cartridge frame 8. The development unit includes a toner (not illustrated), a development roller 12, a toner supply roller 16, and the like. The development cartridge frame 8 accommodates the toner and supports the development unit.

The drum cartridge D includes the photosensitive member 7, a cleaning blade 14 and other structural members serving as a cleaning member for cleaning a surface of the photosensitive member 7, and a drum cartridge frame 13 for supporting these structural members. Hereinbelow, the drum cartridge frame 13 is referred to as the drum frame 13.

The toner accommodated in a toner accommodating unit 9 of the development cartridge C is sent to a development chamber 10. Then, a toner layer is formed on the surface of the development roller 12 by the toner supply roller 16 and a development blade 11. The toner supply roller 16 is arranged around the development roller 12 and rotates in a direction indicated by an arrow E in FIG. 2B while contacting on the development roller 12. The development blade 11 regulates the toner layer on the development roller 12. When the toner formed on the surface of the development roller 12 is transferred to a part of the photosensitive member 7 which corresponds to an electrostatic latent image formed on the photosensitive member 7, a toner image is formed on the photosensitive member 7.

Further, the toner image on the photosensitive member 7 is transferred to the recording material 2 by the transfer roller 4, and then the cleaning blade 14 scrapes off the toner remained on the photosensitive member 7 to collect (remove) the residual toner to a waste toner chamber 15.

Then, a charging roller 18 serving as a charging unit uniformly charges the surface of the photosensitive member 7, thus the image forming apparatus is ready for forming an electrostatic latent image by the optical system 1.

(3) Drum Cartridge

A general configuration of the drum cartridge is described below with reference to FIG. 2B, FIG. 3, and FIGS. 4A to 4C.

Figure 3:
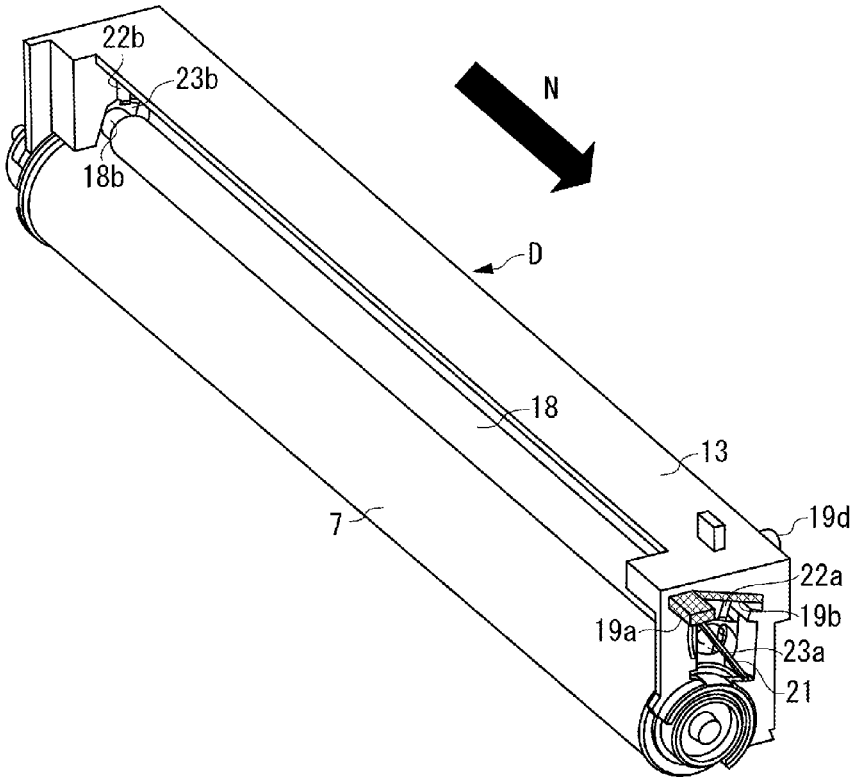
FIG. 3 is a perspective view illustrating a schematic configuration of the drum cartridge according to the first exemplary embodiment.

FIG. 3 is a perspective view illustrating the general configuration of the drum cartridge D in a state that the process cartridge B is mounted on the apparatus main body 100 of the image forming apparatus A, especially illustrating a configuration of a part related to a charging process.

Figure 4A:
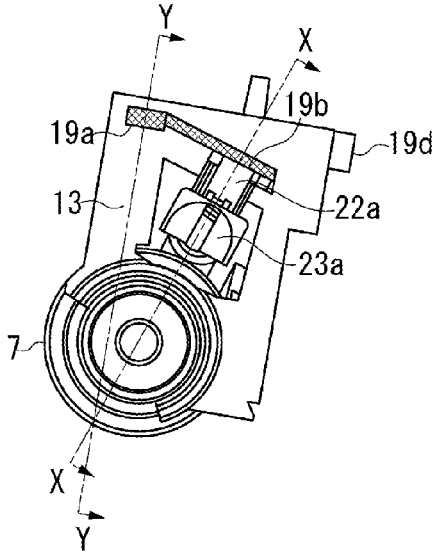
FIGS. 4A to 4C are side views of the drum cartridge on which a contact unit is provided according to the first exemplary embodiment.
Figure 4B:
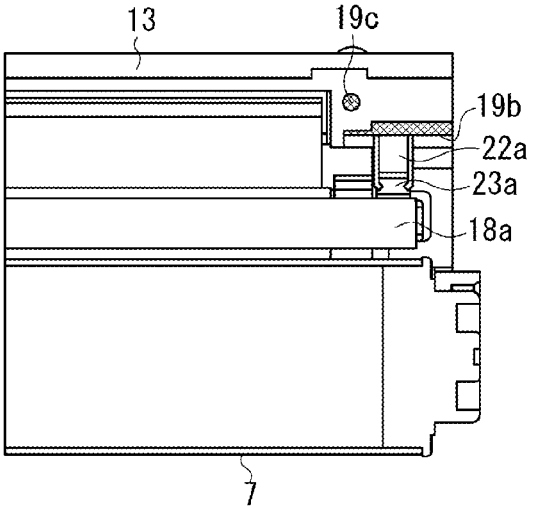
Figure 4C:
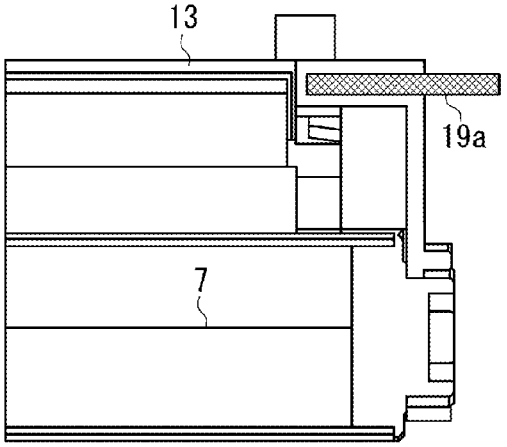

FIG. 4A is a side view (seen from a downstream of an arrow N in FIG. 3) of a side on which the contact unit of the drum cartridge D is provided. FIG. 4B is a schematic cross sectional view of a periphery of a spring seating surface forming portion along a line X-X in FIG. 4A. FIG. 4C is a schematic cross sectional view of a periphery of a contact surface along a line Y-Y in FIG. 4A.

As illustrated in FIG. 3 and FIGS. 4A to 4C, both ends of a shaft core of the charging roller 18 for charging the surface of the photosensitive member 7 are rotatably supported by a charging roller terminal 23*b* and a charging roller terminal 23*a* formed in a conductive material (for example, a conductive resin). Hereinbelow, the both ends 18*a* and 18*b* of the shaft core of the charging roller 18 in these figures are referred to as the charging roller core bars 18*a* and 18*b*.

To the charging roller terminals 23*a* and 23*b*, conductive compression springs 22*a* and 22*b* are respectively attached. The charging roller terminals 23*a* and 23*b* are attached to the drum frame 13 in a state that the compression springs 22*a* and 22*b* can be compressed. Accordingly, the charging roller 18 is supported by the drum frame 13. In addition, as illustrated in FIG. 4B, when the photosensitive member 7 and the charging roller 18 are brought into contact with each other, the compression springs 22*a* and 22*b* are compressed, and the charging roller 18 is pressed (urged) against the photosensitive member 7 at a predetermined pressure according to a spring force (urging force) generated on the compression springs 22*a* and 22*b* at that time.

(4) Configuration of Contact of Drum Cartridge and Voltage Application Method

A charging method of the photosensitive member 7 is described below with reference to FIG. 3, FIGS. 4A to 4C, FIGS. 14A and 14B, and FIGS. 16A to 16H.

As illustrated in FIG. 3 and FIGS. 4A to 4C, a contact unit 19 serving as an injection member is integrally formed with the drum frame 13. As a forming method, which will be specifically described in an article (8), the contact unit 19 is formed in such a manner that a conductive resin 34 (or a resin including a conductive material, such as a molten resin) is injected into a gap (a space) which is formed when the drum frame 13 and molds 27 and 28 are closely contact with each other (see FIG. 10).

In other words, a conductive molten resin is injected into a space between the drum frame 13 and the mold abutting on the drum frame 13, so that the contact unit 19 serving as a cartridge electrode member is formed.

Figure 14A:
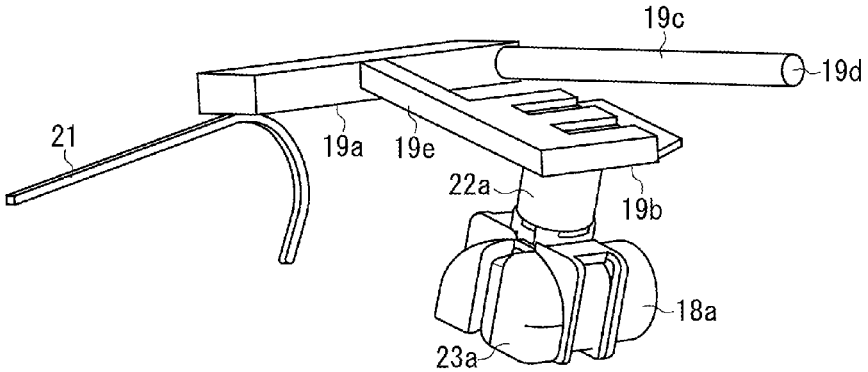
FIGS. 14A and 14B are views in which a main body electrode, a compression spring, and a charging roller terminal are indicated with respect to FIGS. 12A to 12C.
Figure 14B:
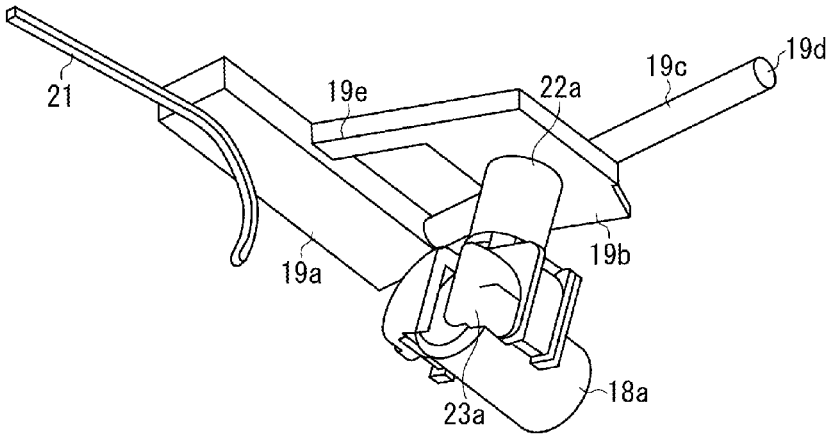

Further, the contact unit 19 serves as a conduction path (a conductive path) for electrically connecting a main body electrode 21 of the apparatus main body 100 and the charging roller 18 when the process cartridge B is mounted on the apparatus main body 100 The charging roller 18 is rotatably mounted and corresponds to a power-supplied member which is electrically connected to the main body electrode 21 serving as a main body contact (a main body electrical contact) provided to the apparatus main body 100. FIGS. 14A and 14B, which are described in an article (9), illustrate the contact unit 19, the main body electrode 21, a compression spring (spring member) 22*a* as a conduction member, and the charging roller terminal 23*a*.

The contact unit 19 as the injection member includes a first contact unit and a second contact unit (hereinbelow, the first contact unit is referred to as a charging roller contact unit 19*b*, and the second contact unit referred to as a main body contact contacting surface (a contact surface) 19*a*).

Further, the contact unit 19 includes, which is described in an article (9), the contact surface 19*a*, the charging roller contact unit 19*b*, a resin laying path 19*c*, a resin gate portion (hereinbelow, referred to as an injection portion) 19*d*, and a branch portion 19*e*.

The charging roller contact unit 19*b* branches off from the contact surface 19*a*, and the contact surface 19*a* and the charging roller contact unit 19*b* are connected via the branch portion 19*e* and integrally formed.

The contact surface 19*a* protrudes from a surface (is exposed on a surface) of a side of the drum frame 13 (one end side surface in a rotation shaft direction of the photosensitive member 7, which is the downstream of the arrow N in FIG. 3).

When the process cartridge B is mounted on the apparatus main body 100, the main body electrode 21 provided to the apparatus main body 100 is brought into contact with the contact surface 19*a* (electrical contact) of the contact unit 19 integrally formed with the drum frame 13.

On the other hand, as illustrated in FIGS. 4A and 4B, the charging roller contact unit 19*b*, which is a part of the contact unit 19 serving as the injection member, abuts on the compression spring 22*a* as a the seating surface supporting the compression spring 22*a*, so that the compression spring 22*a* and the contact unit 19 are in an electrically connectable state.

After the process cartridge B is mounted on the apparatus main body 100, voltage is output to the main body electrode 21 based on an instruction from a controller (not illustrated) of the apparatus main body 100. Accordingly, the voltage is applied to the surface of the charging roller 18 via the contact surface 19*a*, the branch portion 19*e*, the charging roller contact unit 19*b*, the compression spring 22*a*, the charging roller terminal 23*a* formed from the conductive resin, and the shaft core 18*a*.

Then, the surface of the photosensitive member 7 is uniformly charged by the charging roller 18. As described above, the contact unit 19 is provided in order to electrically connect the charging roller 18 and the main body electrode 21.

According to the present exemplary embodiment, the main body electrode 21 and the contact unit 19 are directly connected to each other, however, the main body electrode 21 and the contact unit 19 may be electrically connected in an indirect manner via another conductive member provided therebetween. Further, according to the present exemplary embodiment, the contact unit 19 and the charging roller 18 are electrically connected to each other via the charging roller terminal 23*a* and the compression spring 22*a*, however, the contact unit 19 and the charging roller 18 may be directly connected to each other.

Furthermore, according to the present exemplary embodiment, a case where the charging roller 18 is applied as a power-supplied member, and the contact unit 19 serving as the injection member is applied to the charging process of the photosensitive member 7 is describe. However, the present exemplary embodiment is not limited to this example. More specifically, the injection member according to the present disclosure can be applied to all configurations which require electrical connections for a power supply process of the development roller 12, a power supply process of the toner supply roller 16, and a drum grounding (not illustrated) as well as electrical connections for a detection circuit (not illustrated) for a toner remaining amount and the like.

(5) Drum Cartridge Frame

A shape of the drum frame 13 is described with reference to FIGS. 1A to 1F, and FIGS. 5A to 5E.

Figure 1A:
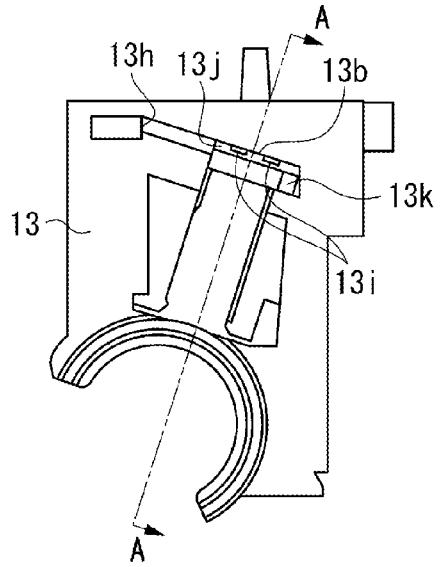
FIGS. 1A to 1F illustrate a frame of a drum cartridge before and after a conductive resin is injected according to a first exemplary embodiment.
Figure 1B:
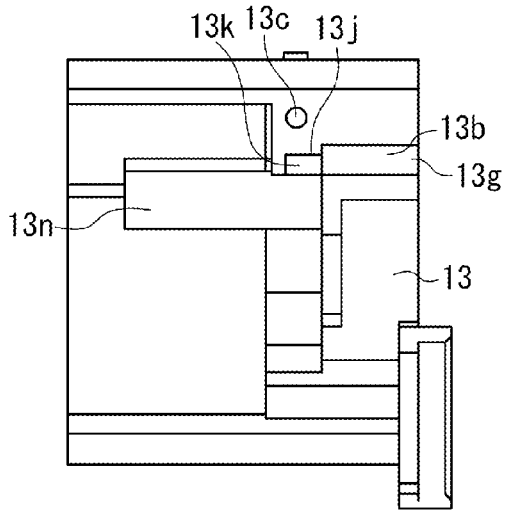
Figure 1C:
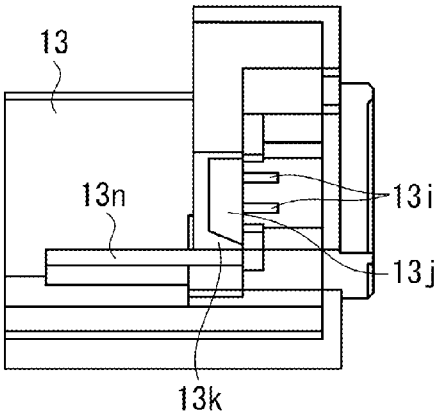
Figure 1D:
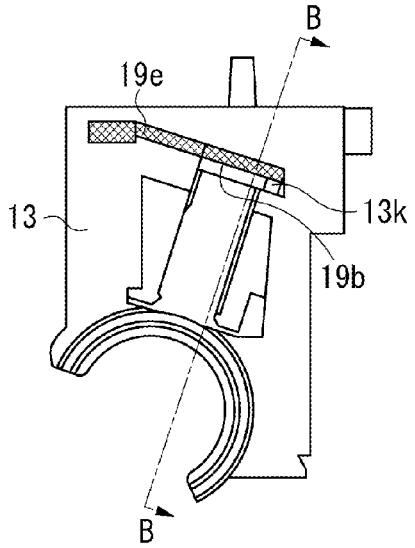
Figure 1E:
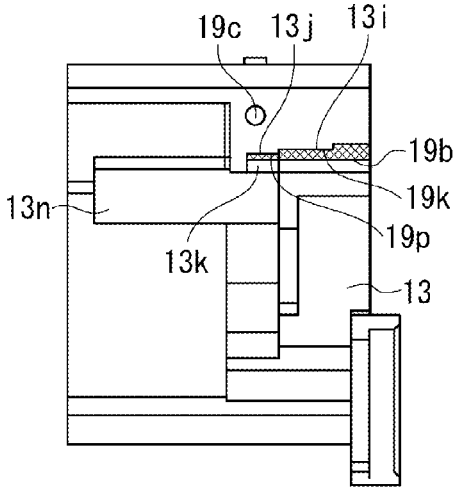
Figure 1F:
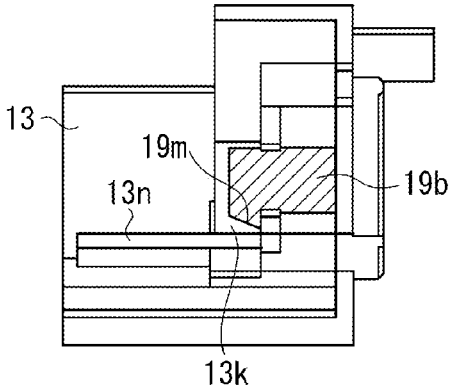
Figure 5A:
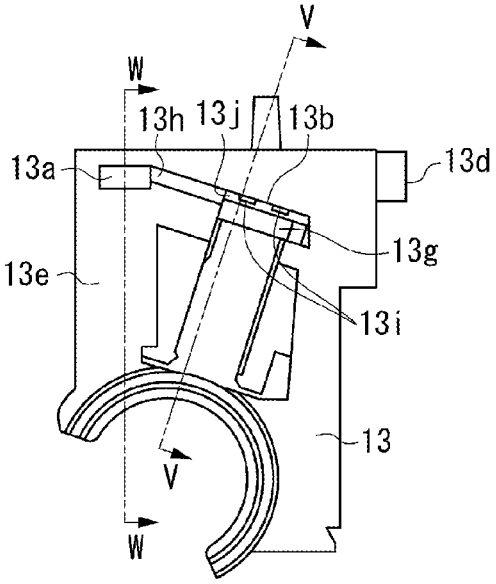
FIGS. 5A to 5E illustrate a configuration of a drum cartridge frame before a conductive resin is injected.
Figure 5B:
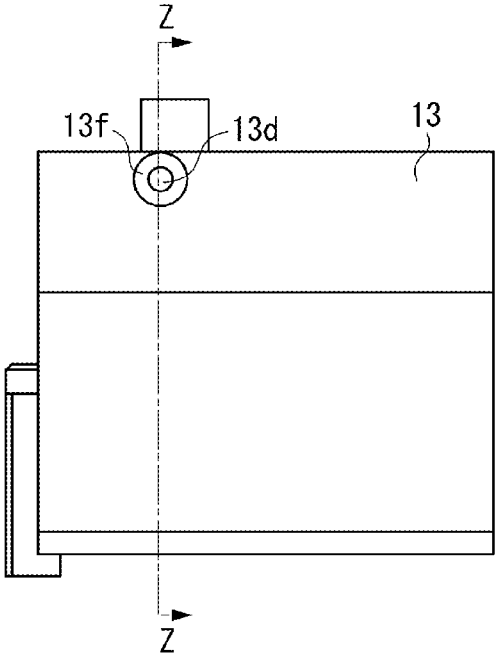
Figure 5C:
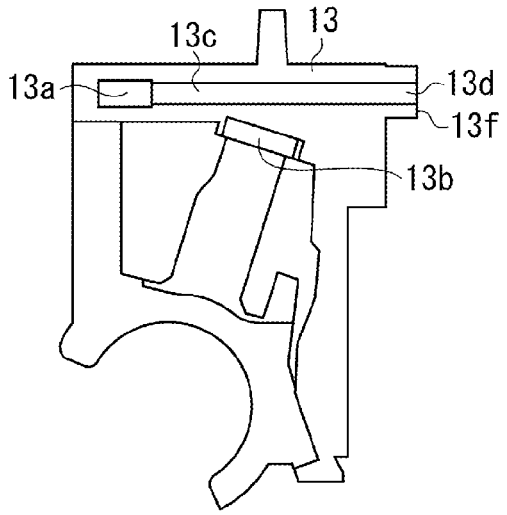
Figure 5D:
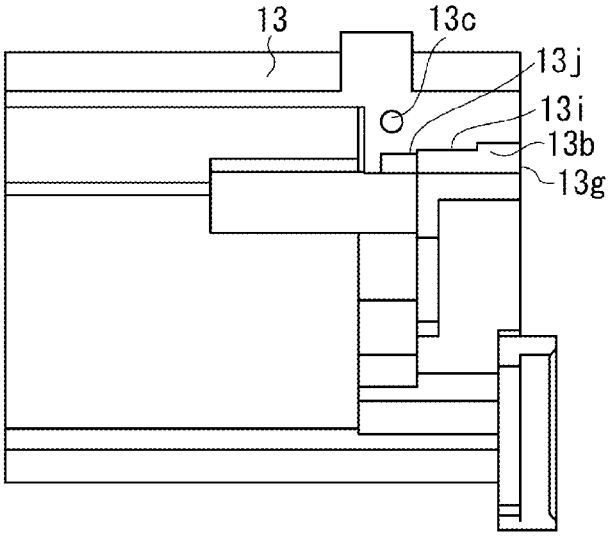
Figure 5E:
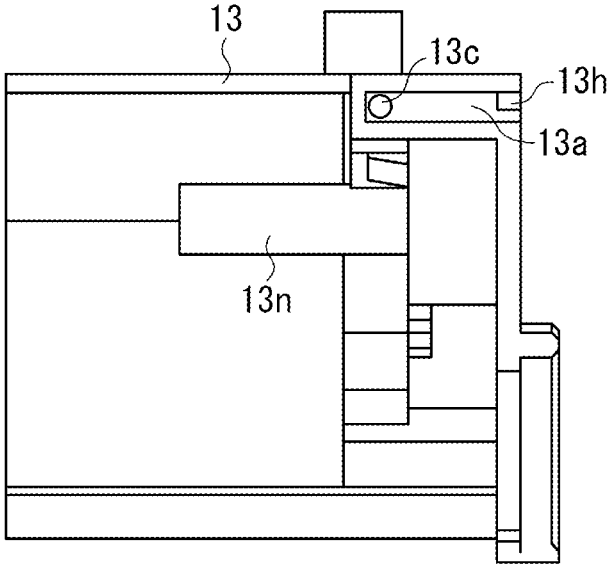

FIGS. 1A to 1F illustrate a spring seating surface forming portion 13*b* of the drum frame 13 before and after a conductive resin 34 is injected. FIGS. 1A to 1C illustrate the states before the conductive resin 34 is injected. FIG. 1A is a side view of a contact unit forming side of the drum frame 13 (a view seen from the downstream of the arrow N in FIG. 3). FIG. 1B is a cross sectional view along with an A-A line in FIG. 1A. FIG. 1C illustrates a first strip-shape rib 13*i* and a second strip-shape rib 13*j* in FIG. 1A seen from below in a vertical direction (a direction of a cutting-plane line of the A-A section). FIGS. 1D to 1F illustrate the states after the contact unit 19 is formed which respectively correspond to FIGS. 1A to 1C. FIG. 1E is a cross sectional view along with a B-B line in FIG. 1D. FIGS. 5A to 5E illustrate shaped of the drum frame 13 before the conductive resin 34 is injected. FIG. 5A is a side view of the contact unit forming side of the drum frame 13 (a view seen from the downstream of the arrow N in FIG. 3). FIG. 5B is a partial outline view of the drum frame 13 seen from a side of a frame injection port 13*d* of a resin (a right side view when FIG. 5A is a front view). FIG. 5C is a cross sectional view along a Z-Z line in FIG. 5B. FIG. 5D is a cross sectional view along a V-V line in FIG. 5A. FIG. 5E is a cross sectional view along a W-W line in FIG. 5A.

As illustrated in FIG. 1A to 1C and FIGS. 5A to 5E, the spring seating surface forming portion 13*b* of the drum frame 13 includes a portion adjacent to a mounting surface 13*n* serving as a supporting portion to support (fix) the cleaning blade 14. The spring seating surface forming portion 13*b* of the drum frame 13 includes the first strip-shape rib 13*i* and the second strip-shape rib 13*j*. A height of the second strip-shape rib 13*j* is larger than that of the first strip-shape rib 13*i* (a position in a downward direction in FIG. 1B). In addition, the second strip-shape rib 13*j* is not configured to reach an end portion of an inlet of a mold insertion port 13*g* (a right side of FIG. 1B).

The first strip-shape rib 13*i* and the second strip-shape rib 13*j* are arranged vertically to each other, and two of the first strip-shape ribs 13*i* are arranged (see Fig. FIGS. 5A to 5E). However, the first strip-shape rib 13*i* is not limited to two as long as at least one rib is arranged.

In addition, as illustrated in FIGS. 5A and 5C, the drum frame 13 includes a frame contact surface forming portion 13*a*, the spring seating surface forming portion 13*b*, and the mold insertion port 13*g*. The frame contact surface forming portion 13*a* is a portion for forming the contact surface 19*a*. The spring seating surface forming portion 13*b* is a portion (region) for forming the charging roller contact unit 19*b* serving as the seating surface receiving the compression spring 22*a* in the drum frame 13. The drum frame 13 includes a mold abutting surface 13*e* on which the mold 27 abuts (see an article (6)) and a mold abutting surface 13*f* on which the mold 28 abuts (see an article (7)) when the contact surface 19*a* is formed. The drum frame 13 also includes the frame injection port 13*d* for injecting the conductive resin 34. The drum frame 13 further includes a tunnel-shaped resin flow path (resin path) 13*c*. The frame contact surface forming portion 13*a* communicates with the spring seating surface forming portion 13*b* via a frame branch portion 13*h*.

(6) Contact Portion Forming Mold

Figure 6:
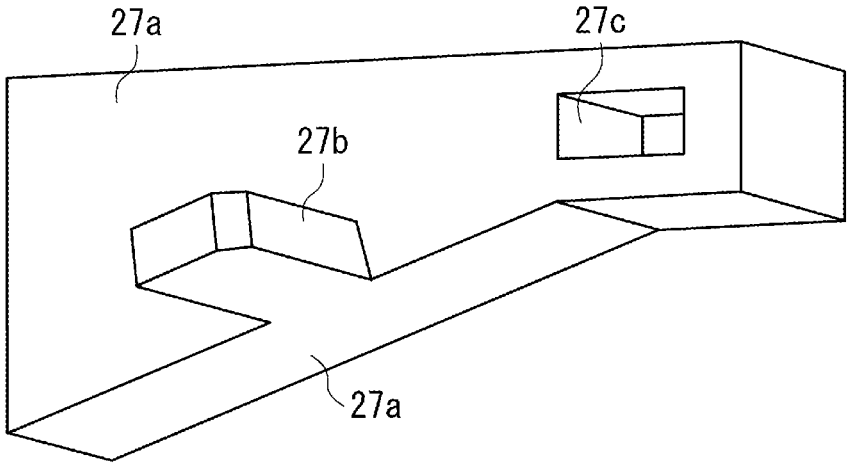
FIG. 6 illustrates a mold to be brought into contact with the drum cartridge frame according to the first exemplary embodiment.

A mold for forming the contact unit 19 is described below with reference to FIGS. 5A to 5E, FIG. 6, FIGS. 11A to 11C, and FIGS. 12A to 12C. FIG. 6 illustrated one (the mold 27) of two molds which abut on the drum frame 13.

Figure 11A:
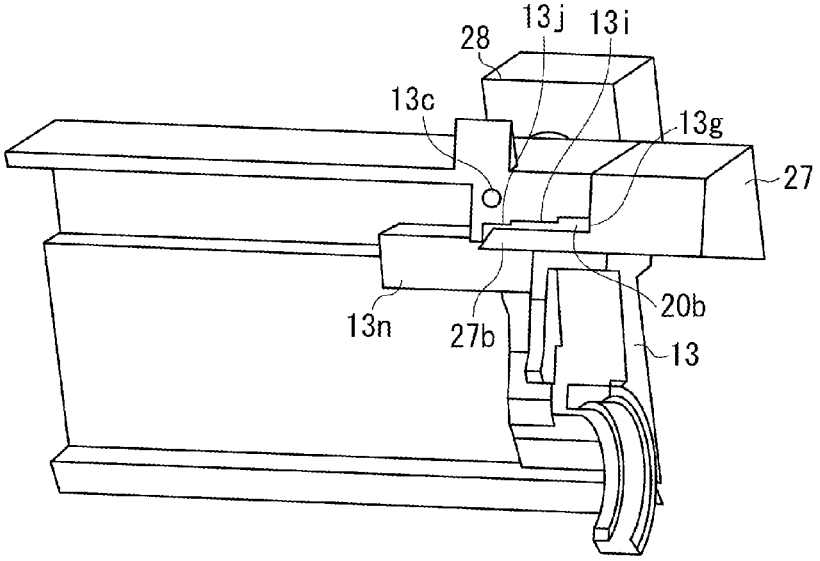
FIGS. 11A to 11C illustrate a contact unit of a charging roller according to the first exemplary embodiment.
Figure 11B:
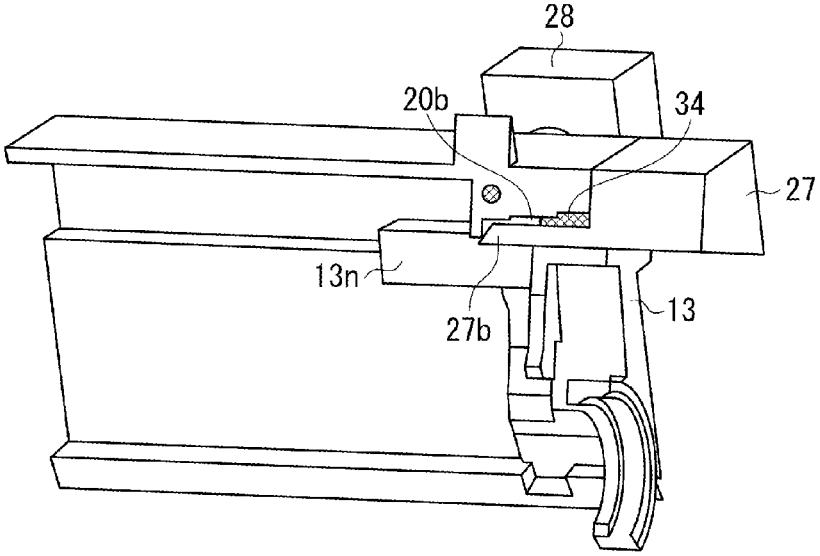
Figure 11C:
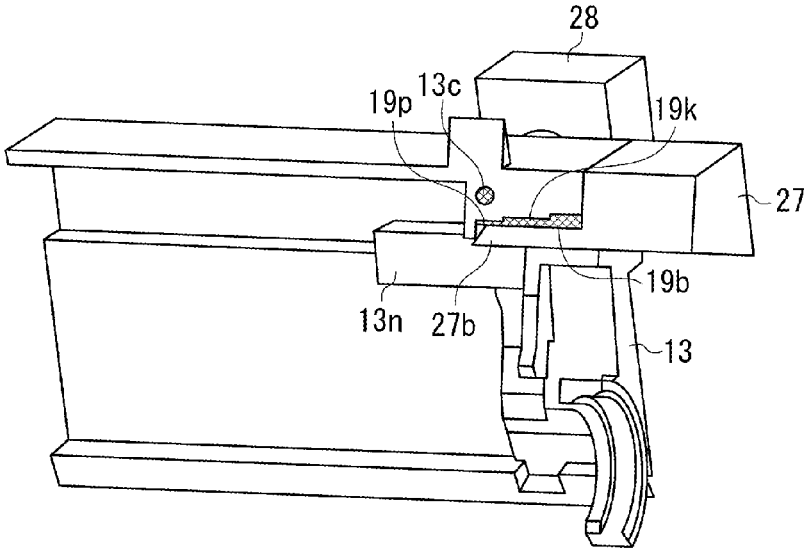

FIGS. 11A to 11C are schematic diagrams illustrating the charging roller contact unit 19*b* when the drum frame 13 is brought into contact with the mold 27, and the conductive resin 34 is injected thereto. FIG. 11A is a schematic perspective view illustrating a state when the mold 27 abuts on the drum frame 13, a protrusion 27*b* of the mold 27 is inserted into the mold insertion port 13*g*, and a spring seating surface forming portion 20*b* is formed, which is partially illustrated as a cross sectional view. FIG. 11B is a schematic perspective view illustrating a state when the conductive resin 34 passes through the frame branch portion 13*h* and flows into the spring seating surface forming portion 20*b*, which is partially illustrated as a cross sectional view. FIG. 11C is a schematic perspective view illustrating a state when the injection of the conductive resin 34 to the spring seating surface forming portion 20*b* is completed, which is partially illustrated as a cross sectional view.

Figure 12A:
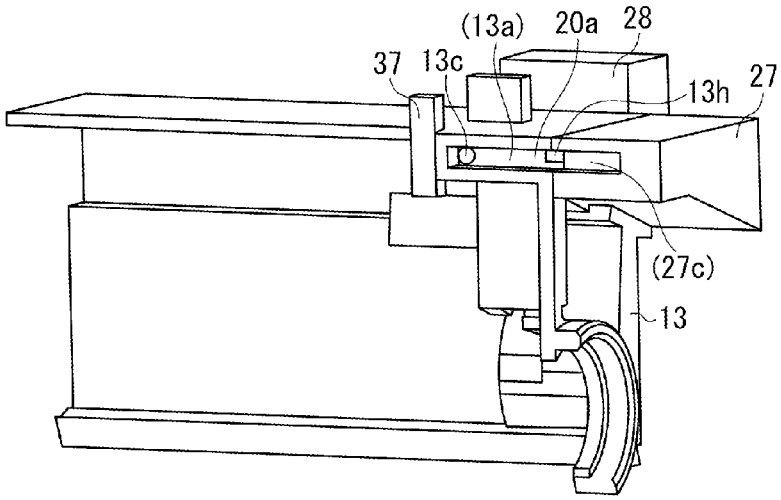
FIGS. 12A to 12C illustrate a contact surface according to the first exemplary embodiment.
Figure 12B:
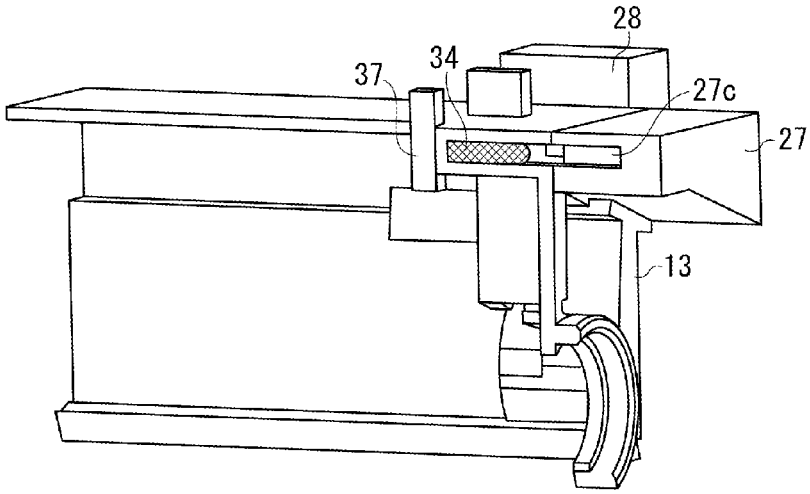
Figure 12C:
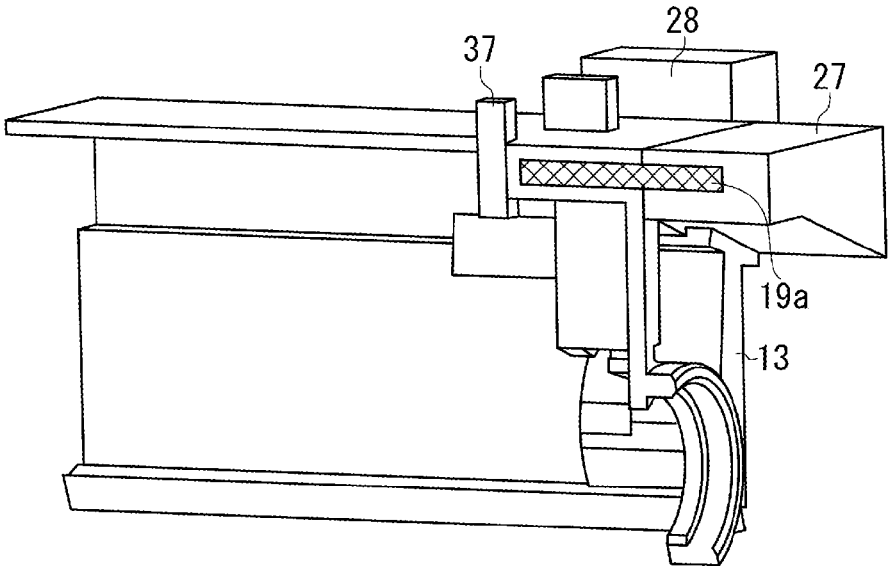

FIGS. 12A to 12C are schematic diagrams illustrating the contact surface 19*a* when the drum frame 13 is brought into contact with the mold 27, and the conductive resin 34 is injected thereto. FIG. 12A is a schematic perspective view illustrating a state when the mold 27 abuts on the drum frame 13, the frame contact surface forming portion 13*a* of the drum frame 13 and a contact surface forming trench 27*c* of the mold 27 are engaged, and a contact surface forming portion 20*a* is formed, which is partially illustrated as a cross sectional view. FIG. 12B is a schematic perspective view illustrating a state when the conductive resin 34 passes through the tunnel-shaped resin flow path 13*c* and flows into the contact surface forming portion 20*a*, which is partially illustrated as a cross sectional view. FIG. 12C is a schematic perspective view illustrating a state when the injection of the conductive resin 34 to the contact surface forming portion 20*a* is completed, which is partially illustrated as a cross sectional view.

As illustrated in FIG. 6, the mold 27 for forming the contact unit 19 includes surfaces 27*a*, a trench (recess) 27*c*, and the protrusion 27*b*. The surfaces 27*a* are surfaces abut on the mold abutting surface 13*e* of the drum frame 13. The trench (recess) 27*c* is used to form the contact surface 19*a*. The protrusion 27*b* is inserted into the mold insertion port 13*g* to form the charging roller contact unit 19*b* serving as the seating surface receiving the compression spring 22*a*.

(7) Injection Gate Mold

The mold 28 is described below with reference to FIGS. 5A to 5E, FIG. 7, and FIGS. 10A to 10C. The mold 28 is the other one of the two molds described in the article (6) to which the conductive resin 34 is injected when the contact unit 19 is formed.

Figure 7:
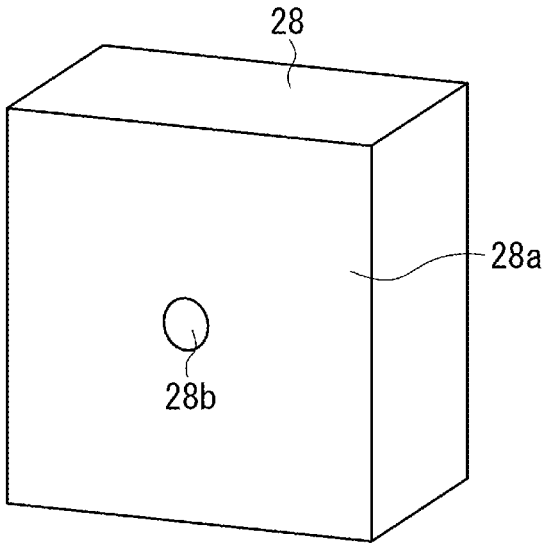
FIG. 7 illustrates a mold to be brought into contact with the drum cartridge frame according to the first exemplary embodiment.
Figure 10A:
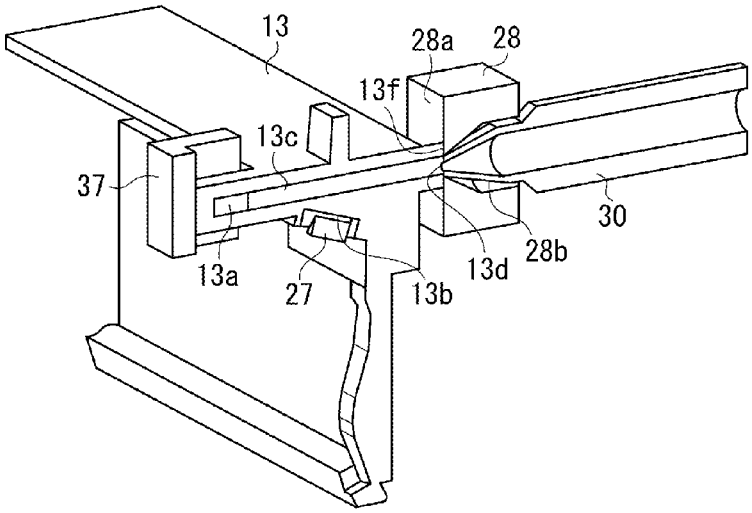
FIGS. 10A to 10C illustrate how a conductive resin according to the first exemplary embodiment is completely injected in chronological order.
Figure 10B:
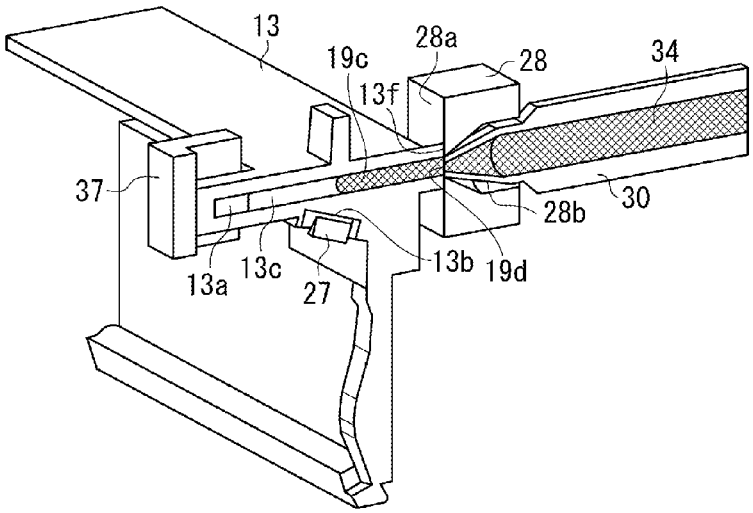
Figure 10C:
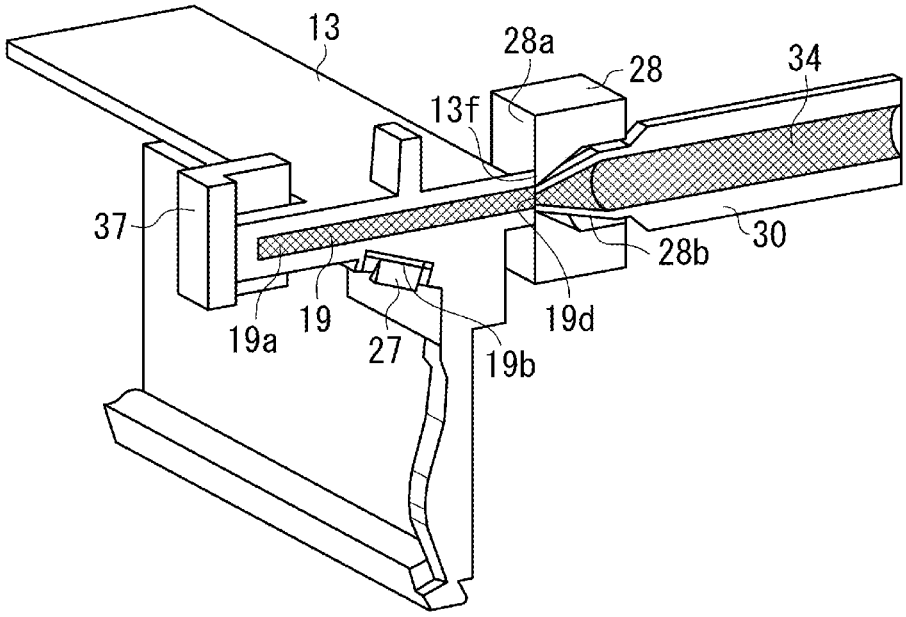

FIG. 7 illustrates the mold 28 which is the other one of the two molds brought into contact with the drum frame 13 which are described in the article (6). FIGS. 10A to 10C are schematic perspective views illustrating in chronological order from when the mold 28 abuts on the drum frame 13 to when the injection of the conductive resin 34 is completed, which are partially illustrated as cross sectional views.

The mold 28 includes a surface 28*a* abutting on the mold abutting surface 13*f* of the drum frame 13 and an injection port 28*b* which is an injection port for injecting the conductive resin 34 and to which a gate 30 is inserted. The injection port 28*b* includes a recessed portion which is provided in the back of the surface 28*a* abutting on the mold abutting surface 13*f* of the drum frame 13 and to which the gate 30 is inserted. Regarding the injection port 28*b*, a surrounding surface of the recessed portion as a taper shape, and a through hole is disposed in the center of the recessed portion as an injection port for injecting the conductive resin 34.

(8) Contact Portion Forming Method

Methods for forming the contact surface 19*a* and the charging roller contact unit 19*b* are described below with reference to FIGS. 4A to 4C, FIGS. 5A to 5E, FIG. 6, FIG. 7, FIGS. 8A to 8D, FIGS. 9A to 9D, FIGS. 11A to 11C, and FIGS. 12A to 12C.

FIGS. 8A to 8D are schematic perspective views illustrating in chronological order when the molds 27 and 28 abut on the drum frame 13.

The contact unit 19 is integrally formed with the drum frame 13 when the conductive resin 34 is injected into a space formed between the drum frame 13 and the mold 27.

Figure 8A:
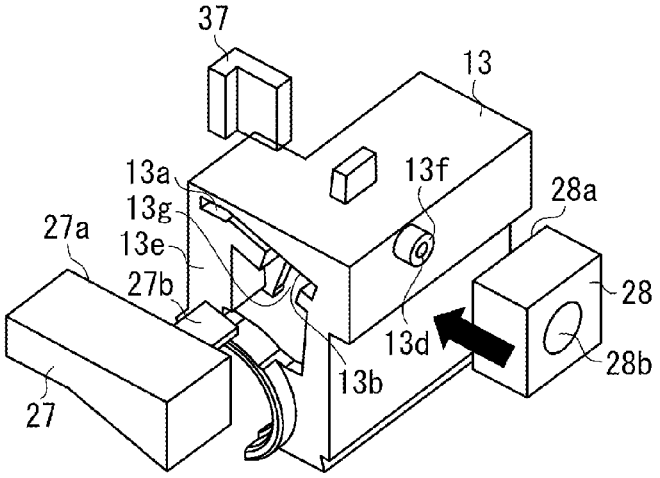
FIGS. 8A to 8D illustrate how a mold according to the first exemplary embodiment is brought into contact with the drum cartridge frame in chronological order.

First, as illustrated in FIG. 8A, the mold 28 abuts on the drum frame 13 (in a direction indicated by an arrow in the drawing). At that time, the mold abutting surface 13*f* of the drum frame 13 abuts on the surface 28*a* of the mold 28.

Figure 8B:
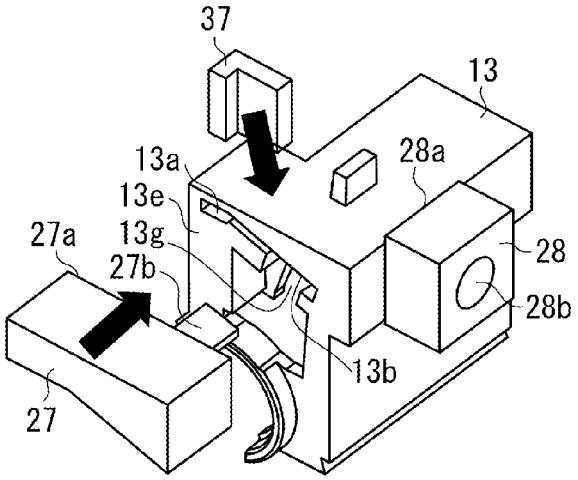

Next, as illustrated in FIG. 8B, the mold 27 abuts on the drum frame 13 (in a direction indicated by an arrow in the drawing). At that time, the mold abutting surface 13*e* of the drum frame 13 abuts on the surface 27*a* of the mold 27. In addition a backup 37 abuts on a surface opposite to the ones on which the molds 27 and 28 abut to prevent the drum frame 13 from being deformed (the backup is described in an article (1)).

Figure 8C:
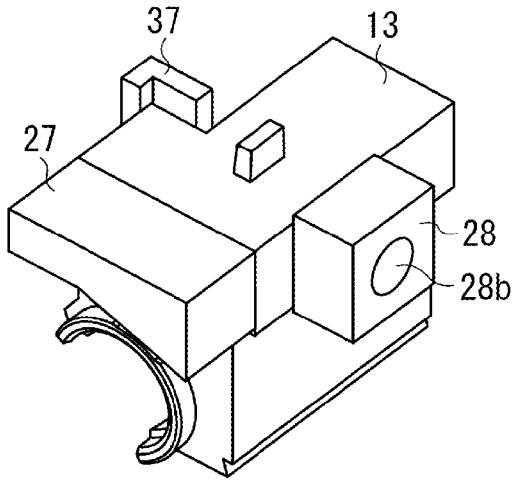

FIG. 8C illustrates a state in which the two molds 27 and 28 and the backup 37 abut on the drum frame 13.

At that time, as illustrated in FIGS. 5A and 5D, and FIG. 11A, the protrusion 27*b* of the mold 27 is inserted into the mold insertion port 13*g*. A gap generated at that time between the protrusion 27*b* of the mold 27 and the drum frame 13 will be the spring seating surface forming portion 20*b*. The mold insertion port 13*g* is a through hole disposed on a longitudinal side wall of the drum frame 13.

Further, as illustrated in FIGS. 6 and 12A, a space between the trench 27*c* and the frame contact surface forming portion 13*a* of the drum frame 13 which is generated when the mold 27 abuts on the drum frame 13 will be the contact surface forming portion 20*a*.

Figure 8D:
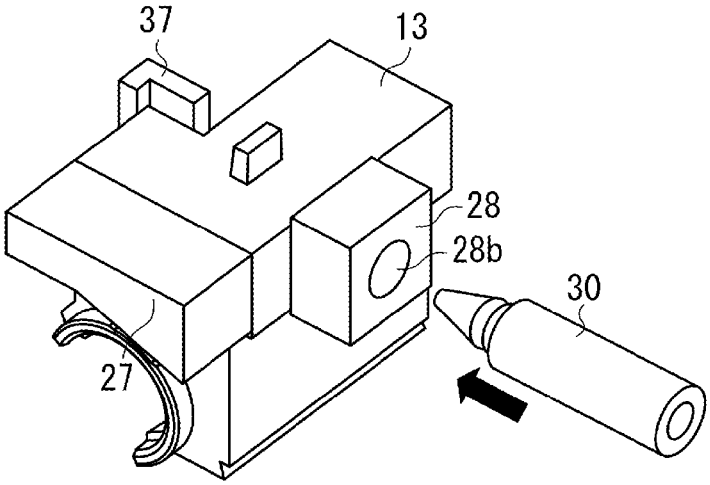

Next, as illustrated in FIGS. 8D and 10A, after the drum frame 13 abuts on the molds 27 and 28, the gate 30 for injecting the conductive resin 34 is inserted into the injection port 28*b* of the mold 28 (in a direction indicated by an arrow in the drawing) to abuts on the back of the injection port 28*b*. The gate 30 and the mold 28 may have an integrated configuration from the beginning. Alternatively, it may be configured that the gate 30 is directly inserted into the frame injection port 13*d* of the drum frame 13 without using the mold 28 to inject the conductive resin 34. Alternatively, it may be configured to provide a surface to the periphery of a leading edge of the gate 30 and insert the conductive resin 34 after the surface abuts on the mold abutting surface 13*f*.

Next, as illustrated in FIG. 10B, the conductive resin 34 is inserted into the tunnel-shaped resin flow path 13*c* of the drum frame 13 via the injection port 28*b*.

The conductive resin 34 advances the tunnel-shaped resin flow path 13*c* of the drum frame 13 and reaches the frame contact surface forming portion 13*a*. Then, a part of the conductive resin 34 which filled the contact surface forming portion 20*a* and reached the frame branch portion 13*h* flows into the spring seating surface forming portion 20*b* which is formed by the drum frame 13 and the mold 27 to fill the space.

FIG. 10C illustrates a state when the conductive resin 34 is injected into a space formed by the contact surface forming portion 20*a* and the spring seating surface forming portion 20*b*.

When the injection of the resin is completed and the mold is opened, as illustrated in FIGS. 1D to 1F, FIGS. 4A to 4C, and FIGS. 14A and 14B, the conductive resin 34 entered into the contact surface forming portion 20*a* forms the contact surface 19*a*, and the conductive resin 34 entered into the spring seating surface forming portion 20*b* forms the charging roller contact unit 19*b*.

The contact surface 19*a* and the charging roller contact unit 19*b* are integrally formed via the branch portion 19*e* by the conductive resin 34 entering into the above-described flow paths and being formed.

As illustrated in FIGS. 5A to 5E, the tunnel-shaped resin flow path 13*c* which is a laying path from the frame injection port 13*d* to the frame contact surface forming portion 13*a* is surrounded by the drum frame 13.

Next, mold release is described.

FIGS. 9A to 9D are schematic perspective views illustrating in chronological order from the completion of the injection of the resin to when the molds 27 and 28 and the gate 30 which abut on the drum frame 13 are released from the drum frame 13 (mold release).

Figure 9A:
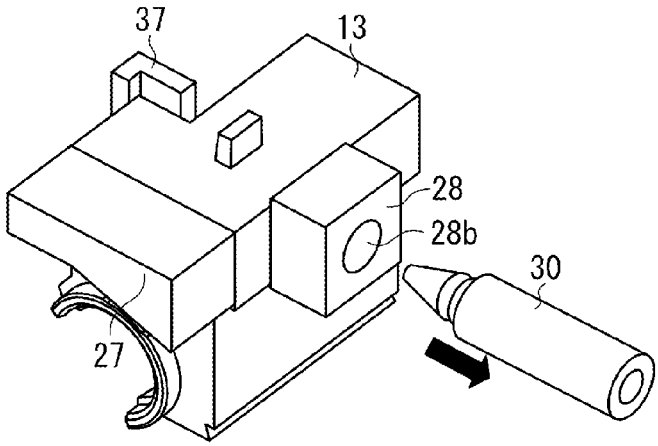
FIGS. 9A to 9D illustrate how a mold according to the first exemplary embodiment is separated from the drum cartridge frame in chronological order.
Figure 9B:
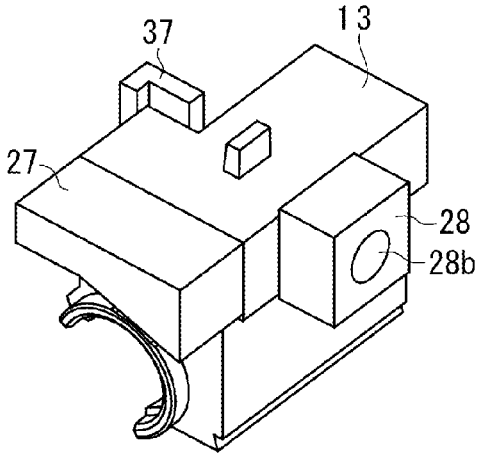
Figure 9C:
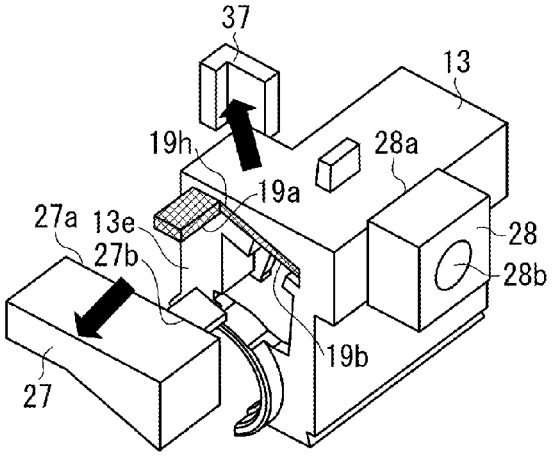
Figure 9D:
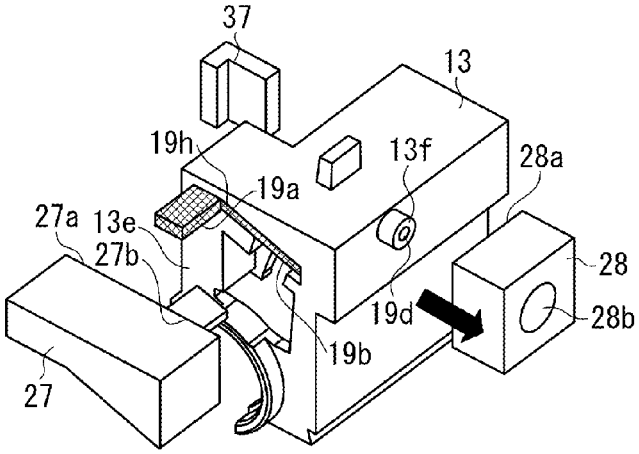

First, as illustrated in FIG. 9A, the gate 30 is retracted from the injection port 28*b* of the mold 28 (in a direction indicated by an arrow in the drawing). Next, as illustrated in FIG. 9C, the mold 27 and the backup 37 are separated from the drum frame 13 (in directions indicated by arrows in the drawing). Lastly, as illustrated in FIG. 9D, the mold 28 is separated from the drum frame 13 (in a direction indicated by an arrow in the drawing), so that the drum frame 13 is obtained in a state integrally formed with the contact unit 19 (the contact surface 19*a* and the charging roller contact unit 19*b*).

In a configuration which does not used the mold 28, the gate 30 is retracted from the drum frame 13 after injection of the conductive resin 34, and then the mold 27 and the backup 37 are retracted in this order. Accordingly, the drum frame 13 can be obtained in a state integrally formed with the contact unit 19 (the contact surface 19*a* and the charging roller contact unit 19*b*).

(9) Function of Each Shape of Contact Unit

Next, shapes of the formed contact unit 19 are described with reference to FIGS. 1A to 1E, FIGS. 5A to 5E, FIGS. 13A to 13F, and FIGS. 14A and 14B.

Figure 13A:
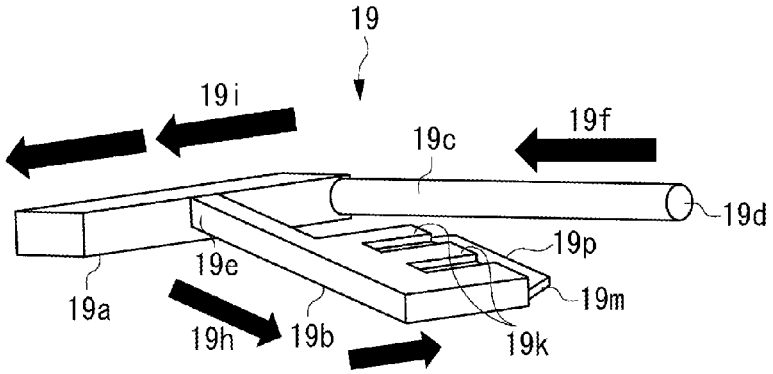
FIGS. 13A to 13F illustrate functions of the contact unit when release from the mold is completed and forming is finished according to the first exemplary embodiment.
Figure 13B:
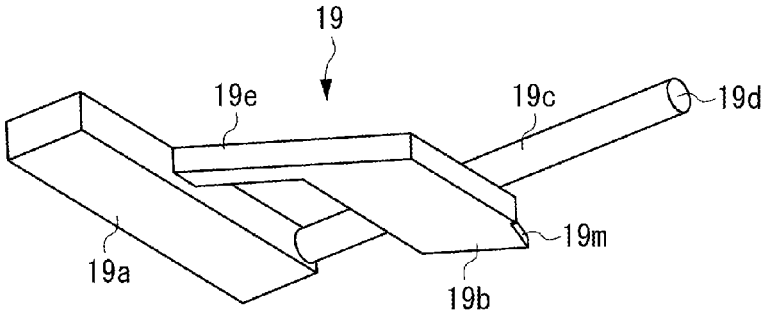
Figure 13C:
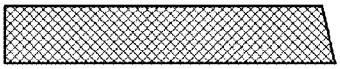
Figure 13D:
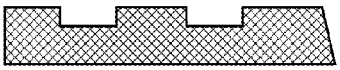
Figure 13E:
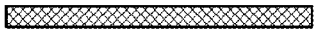
Figure 13F:
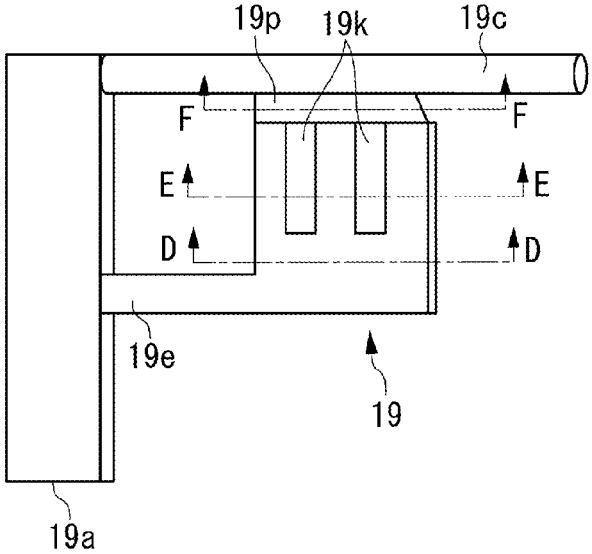

FIGS. 13A to 13F illustrate functions of the contact unit 19 in which the mold release and forming are finished. In FIGS. 13A to 13F, the drum frame 13 is not indicated. FIGS. 13A and 13B are schematic perspective views illustrating the contact unit 19. FIG. 13F is a schematic diagram of the charging roller contact unit 19*b* seen from the front. FIGS. 13C to 13E respectively illustrate a D-D cross section, an E-E cross section, and an F-F cross section in FIG. 13F.

FIGS. 14A and 14B illustrates when the main body electrode 21, the compression spring 22*a*, and the charging roller terminal 23*a* are indicated with respect to FIGS. 13A and 13B.

As illustrated in FIGS. 13A to 13F, the contact unit 19 includes the contact surface 19*a* and the charging roller contact unit 19*b*.

As illustrated in FIGS. 14A and 14B, when the process cartridge B is mounted in the apparatus main body 100, the main body electrode 21 is brought into contact with the contact surface 19*a*. When the charging roller 18 is assembled, the charging roller core bar 18*a* abuts on the charging roller terminal 23*a* (formed from the conductive resin) and is rotatably supported thereto. Then, a conduction path is secured from the main body electrode 21 to the charging roller core bar 18*a* via the compression spring 22*a* contacting with the charging roller terminal 23*a*, the charging roller contact unit 19*b* contacting with the compression spring 22*a*, the branch portion 19*e*, and the contact surface 19*a*.

(10) Configuration of Contact Unit and Drum Cartridge Frame for Reducing Heat Amount Next, a configuration of the contact unit 19 for reducing the heat amount is described with reference to FIGS. 1A to 1F, FIGS. 5A to 5E, and FIGS. 13A to 13F.

As illustrated in FIGS. 1A to 1F and FIGS. 5A to 5E, the spring seating surface forming portion 13*b* of the drum frame 13 includes the first strip-shape rib 13*i* and the second strip-shape rib 13*j* which are projection portions.

When the conductive resin 34 flows into the spring seating surface forming portion 13*b*, the conductive resin 34 is injected on the first strip-shape rib 13*i* and the second strip-shape rib 13*j*, and in FIGS. 1E and 1F, the first strip-shape rib 13*i* and the second strip-shape rib 13*j* are covered with the conductive resin 34. The heights of the first strip-shape rib 13*i* and the second strip-shape rib 13*j* are different. However, the charging roller contact unit 19*b* has a flat surface which is the seating surface of the compression springs 22*a* and 22*b*.

When the mold insertion port 13*g*, to which the protrusion 27*b* of the mold 27 is inserted, is seen from outside of the frame, as illustrated in FIG. 1B, with advancing further inside (a direction to the end of the flow path, i.e., left side of FIG. 1B), the first strip-shape rib 13*i* is disposed, and then the second strip-shape rib 13*j* is disposed.

Thus, with the approach to the end of the flow path, a space to which the conductive resin 34 is injected decreases. According to the present exemplary embodiment, the end of the flow path of the conductive resin 34 at the time of forming the contact unit 19 is disposed near the mounting surface 13*n* (the left side of the shaded area in FIG. 1F).

As illustrated in FIG. 13A, when the contact unit 19 is formed, a first strip-shape rib 13*i* facing surface 19*k* and a second strip-shape rib 13*j* facing surface 19*p* are formed on the charging roller contact unit 19*b* as respective surfaces to face (correspond or contact) to the first strip-shape rib 13*i* and the second strip-shape rib 13*j*.

According to the present exemplary embodiment, it is configured that a cross sectional area of the contact unit 19 becomes smaller (reduced in size) in a step-by-step manner with the approach to the end of the flow path (as the cross sectional area comes closer to the mounting surface 13*n*) as illustrated in FIGS. 13C to 13E.

The above-described configuration can reduce a heat amount held by the resin 34 to be injected as the cross sectional area comes closer to the mounting surface 13*n*, so that the injection of the resin 34 can prevent the heat from being transferred to the mounting surface 13*n*. Accordingly, an effect of the heat held by the injected resin 34 on the mounting surface 13*n* can be reduced. As a result, deformation of the drum frame 13 or a deformation amount of the drum frame 13 due to the heat held by the injected resin can be prevented or reduced. In addition, a cooling time of the resin 34 after injection can be shortened.

According to the present exemplary embodiment, a configuration is described in which the end of the flow path of the conductive resin 34 is disposed near the mounting surface 13*n* when the contact unit 19 is formed. However, the present exemplary embodiment is not limited to this configuration. Any configuration can be adopted as long as a cross sectional area of the space to which the resin is injected becomes smaller continuously or in a step-by-step manner with the approach to the supporting portion of the process unit in a case where the supporting portion of the process unit is located in a periphery of a space to which the resin is injected (i.e., the spring seating surface forming portion 13*b* according to the present exemplary embodiment). Thus, a cross sectional area of a portion located in a periphery of the supporting portion of the process unit in the charging roller contact unit 19*b* (i.e., an area of a cross section perpendicular to a direction approaching to the supporting portion) is formed to be smaller continuously or in a step-by-step manner with the approach to the supporting portion.

In addition, a convex shape (protruded) rib may be added to a portion which contacts with the conductive resin 34 in the drum frame 13 (i.e., a region to which the conductive resin 34 is injected) Accordingly, the strength of the drum frame 13 can be improved, and a deformation amount of the drum frame 13 due to the heat of the injected resin 34 can be reduced.

At that time, it is favorable that the rib has a strip shape, especially a slit-like protrusion shape extending along an injection direction (flow direction) of the injected resin 34 as described in the present exemplary embodiment.

By disposing such a rib in a region having a smaller cross sectional area in the space to which the resin is injected, reduction in flowability of the resin 34 due to reduction of the cross sectional area of the space to which the resin is injected can be suppressed.

Further, as illustrated in FIGS. 1A to 1F, it is favorable to provide a rib 13*k* serving as a regulation portion for interfering the flow path of the resin between the spring seating surface forming portion 13*b* and the mounting surface 13*n* to separate between the spring seating surface forming portion 13*b* and the mounting surface 13*n*.

Accordingly, the conductive resin 34 entering into the spring seating surface forming portion 13*b* can be prevented from directly coming closer to or contacting the mounting surface 13*n*, so that heat transfer from the injected resin 34 to the mounting surface 13*n* can be further reduced. As a result, an effect of the heat held by the injected resin 34 on the mounting surface 13*n* can be reduced.

Especially, when the supporting portion of the process unit is located at the end of the flow path, there is a concerns that the resin 34 runs out and moves toward the supporting portion of the process unit. However, according to the above-described configuration, the resin 34 can be prevented from running out toward the supporting portion of the process unit, and the heat transfer from the injected resin 34 to the supporting portion of the process unit can be further reduced. As a result, an effect of the heat held by the injected resin 34 on the supporting portion of the process unit can be further reduced.

(11) Mold Clamping and Backup

Next, mold clamping which is performed during processes for forming the contact surface 19*a* and the charging roller contact unit 19*b* is described with reference to FIG. 6, FIG. 7, FIGS. 8A to 8D, FIGS. 11*a* to 11C, and FIG. 15.

Figure 15:
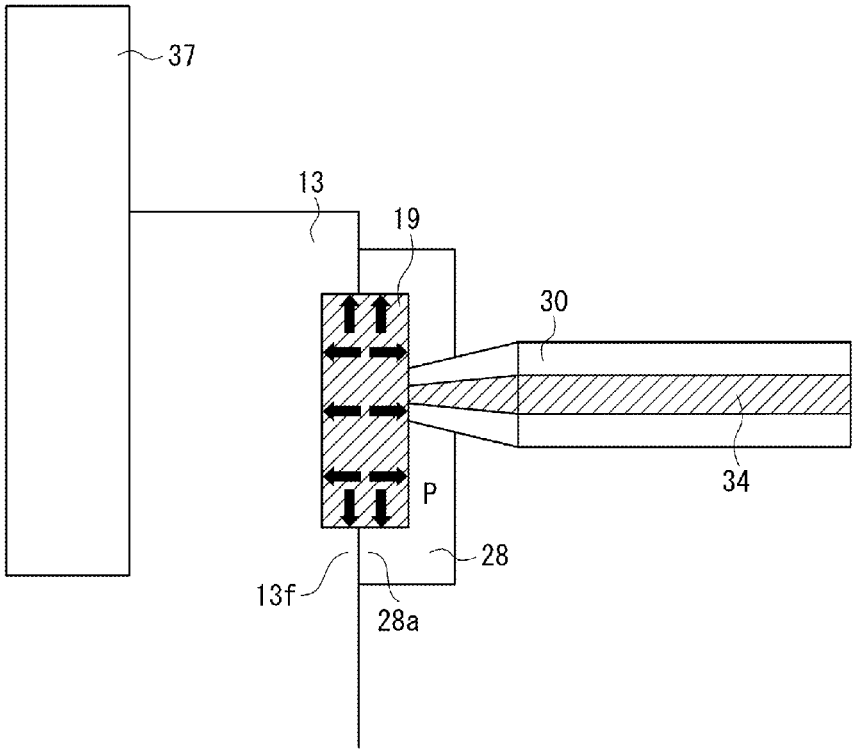
FIG. 15 illustrates a pressure of a resin according to the first exemplary embodiment.

FIG. 15 is a schematic diagram illustrating a pressure of a resin.

When the contact unit 19 is formed, the mold clamping is performed by abutting the surface 27*a* of the mold 27 on the mold abutting surface 13*e* of the drum frame 13. The mold clamping is also performed by abutting the surface 28*a* of the mold 28 on the mold abutting surface 13*f* of the drum frame 13.

At the time of the mold clamping, the backup 37 is brought into contact with the drum frame 13 at the position corresponding to the back sides of the drum frame 13 and the mold abutting surfaces 13*e* and 13*f* of the molds 27 and 28. Accordingly, the backup 37 supports the back sides of the mold abutting surfaces 13*e* and 13*f* of the drum frame 13. The support by the backup 37 is provided so as not to cause the mold abutting surfaces 13*e* and 13*f* of the drum frame 13, the surface 27*a* of the mold 27, and the surface 28*a* of the mold 28 to escape, or not to deform the drum frame 13 due to pressing forces of the molds 27 and 28 and a resin pressure P at the time of resin injection.

According to the present exemplary embodiment, the backup 37 supports the back sides (back surfaces) of the mold abutting surfaces 13*e* and 13*f* respectively. However, a part to be supported is not limited to the back side. The part to be supported by the backup 37 may be any part as long as the escape and the deformation of the drum frame 13 can be suppressed by the support of the backup 37.

According to the present exemplary embodiment, polyacetal containing approximately 10% carbon black is used to the contact unit 19. The reason to use the carbon black is to reduce damage (abrasion and the like) to a production apparatus as much as possible, however, carbon fibers, other metallic additives, and the like can be used.

According to the above-described present exemplary embodiment, an effect of the heat held by the injected resin 34 on the mounting surface 13*n* can be reduced. Accordingly, deformation of the drum frame 13 or a deformation amount of the drum frame 13 due to the heat held by the injected resin can be prevented or reduced. In addition, a cooling time of the resin 34 after injection can be shortened.

According to the present exemplary embodiment, the molten resin to be injected to the frame is described as a conductive resin, however, the resin is not limited to the conductive resin. In addition, it is favorable that the drum frame 13 is formed from a resin, however the drum frame 13 is not limited to this. A configuration in which the injection member is integrally formed with the frame by injecting the molten resin into the frame, and the injection part of the molten resin is located in a periphery of the supporting portion of the process unit in the frame can obtain the above-described effect by applying the present disclosure.

A second exemplary embodiment is described below. Components similar to those in the first exemplary embodiment are denoted with the same reference numeral, and the descriptions thereof are omitted.

FIGS. 16A to 16H and FIGS. 17A to 17C are schematic diagrams illustrating forms in which a cross sectional area of a charging roller contact unit 29*b* of a contact unit 29 become smaller as the cross sectional area comes closer to the mounting surface 13*n* according to the present exemplary embodiment.

Figure 16A:
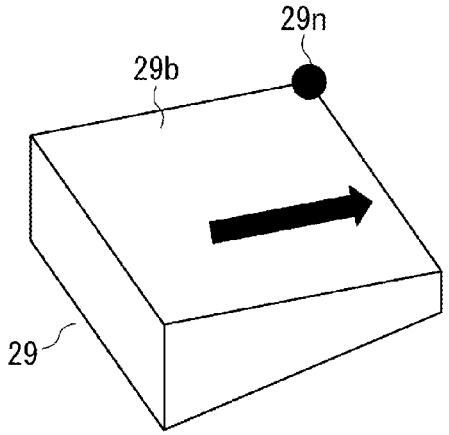
FIGS. 16A to 16H illustrate a configuration of a contact unit according to a second exemplary embodiment.
Figure 16B:
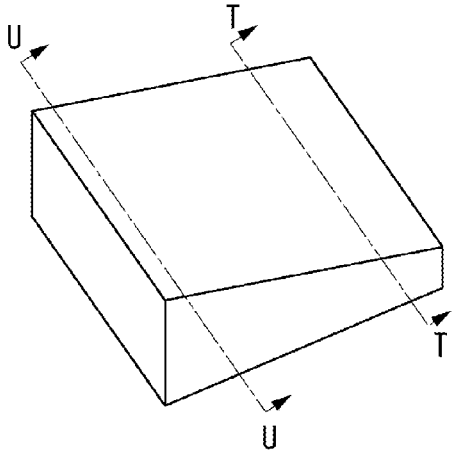
Figure 16C:
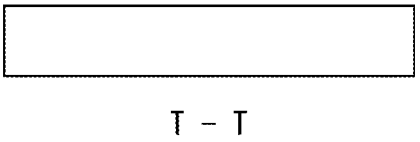
Figure 16D:
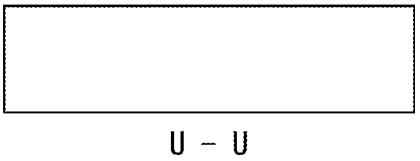

FIGS. 16A and 16B illustrate a shape of the charging roller contact unit 29*b* of which cross sectional area becomes smaller with the approach to the end of the flow path of the resin 34 (in a direction indicated by an arrow in the drawing). FIGS. 16C and 16D are cross sectional views of a T-T cross section and a U-U cross section in FIG. 16B, respectively.

Figure 16E:
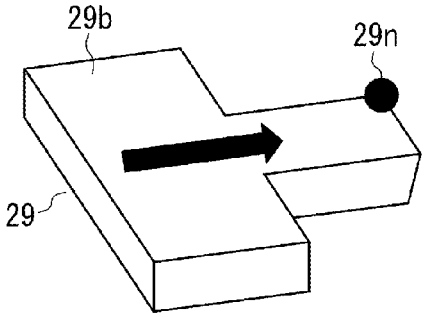
Figure 16F:
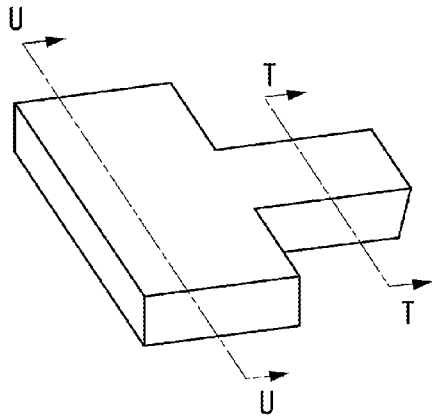
Figure 16G:
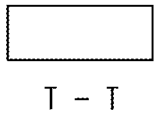
Figure 16H:
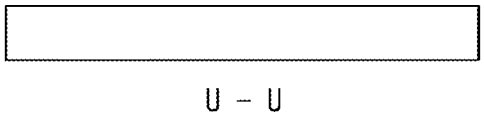

FIGS. 16E to 16H illustrate the contact unit 29 which has a different shape from the contact unit illustrated in FIGS. 16A to 16D so as to correspond with FIGS. 16A to 16D. FIG. 16E illustrates a shape of which cross sectional area becomes smaller in a direction intersecting the flow path (an arrow in FIG. 16E) as illustrated in FIGS. 16G and 16H, as the cross sectional area of the charging roller contact unit 29*b* approaches the mounting surface 13*n* provided to the end of the flow path. A point 29*n* indicated in FIGS. 16A and 16E is a point nearest to the mounting surface 13*n*.

Figure 17A:
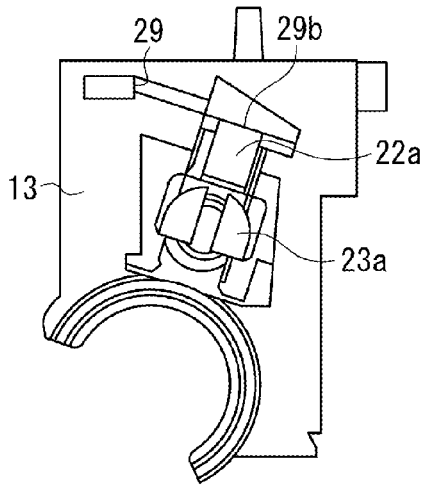
FIGS. 17A to 17C illustrate a configuration of a contact unit according to the second exemplary embodiment.
Figure 17B:
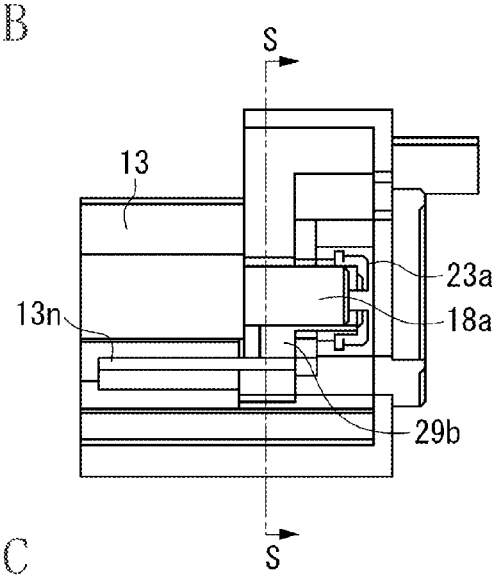
Figure 17C:
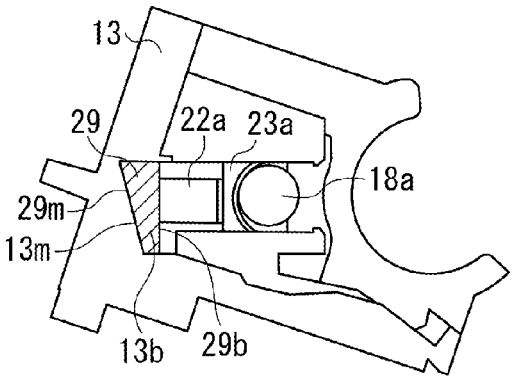

As described above, with the approach to the mounting surface 13*n* near the end of the flow path, a cross sectional area of the charging roller contact unit 29*b* becomes smaller, so that dispersion of the heat held by the injected resin 34 can be prompted, and influence of the heat on the mounting surface 13*n* can be reduced FIGS. 17A to 17C illustrate the drum frame 13 after the contact unit 29 illustrated in FIGS. 16A to 16D is formed by injection of the conductive resin 34. FIG. 17A is a side view of a side on which the contact unit is formed in the drum frame 13 (a view seen from the downstream of the arrow N in FIG. 3). FIG. 17B is a schematic diagram illustrating a part of the drum frame 13 when the charging roller contact unit 29*b* is seen from below in the vertical direction in FIG. 17A. FIG. 17C is across sectional view along with an S-S line in FIG. 17B.

As illustrated in FIGS. 17A and 17C, a thickness of the charging roller contact unit 29*b* becomes thin as a contact tapered portion 13*m* approaches the mounting surface 13*n*.

Such a configuration can also reduce the heat transfer from the injected resin 34 to the mounting surface 13*n*.

Figure 18A:
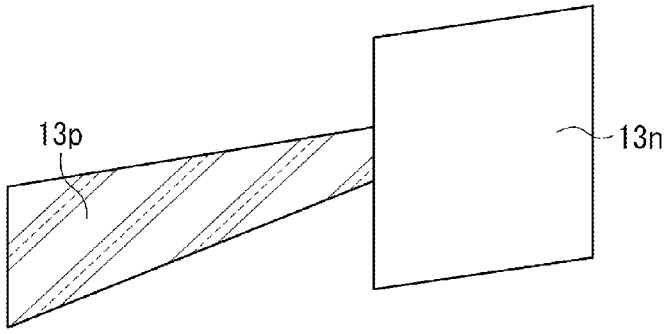
FIGS. 18A and 18B illustrate a configuration of a contact unit according to the second exemplary embodiment.
Figure 18B:
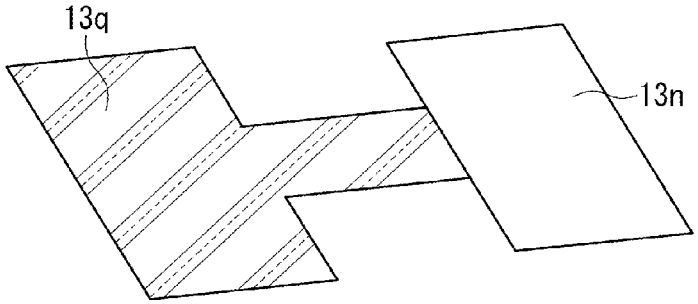

FIGS. 18A and 18B illustrate relationships between a contact range (a contact area) where the contact unit 29 and the drum frame 13 contact with each other and the mounting surface 13*n*.

FIG. 18A illustrates a contact range 13*p* in which the contact unit 29 having a shape illustrated in FIG. 16A contacts with the drum frame 13. FIG. 18B illustrates a contact range 13*q* in which the contact unit 29 having a shape illustrated in FIG. 16B contacts with the drum frame 13.

According to the present exemplary embodiment, as illustrated in FIGS. 18A and 18B, with the approach to the supporting portion of the process unit (i.e., the mounting surface 13*n* according to the present exemplary embodiment), the contact ranges (the contact area) 13*p* and 13*q* become smaller continuously or in a step-by-step manner.

Such a configuration can also reduce the heat transfer from the injected resin 34 to the mounting surface 13*n*.

Figure 19:
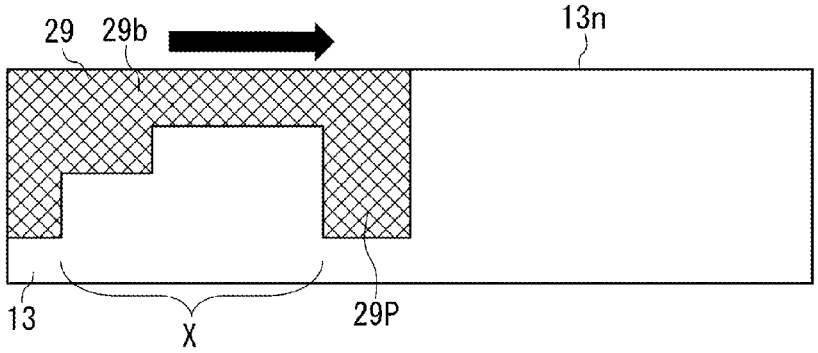
FIG. 19 illustrates another configuration of a contact unit.

FIG. 19 is a schematic cross sectional view illustrating the periphery of the charging roller contact unit 29*b* (a shaded area in the drawing) and the mounting surface 13*n* in the drum frame 13 according to another exemplary embodiment FIG. 19 illustrates a case when a thickness and a cross sectional area of a partial region 29*p*, which is a part nearer to the mounting surface 13*n* in the charging roller contact unit 29*b*, are larger than those on upstream of the flow path (a direction indicated by an arrow in the drawing) of the injected resin 34.

According to the present exemplary embodiment, as illustrated in FIG. 19, a thickness and a cross sectional area of an X region which is a region of the charging roller contact unit 29*b* in the periphery of the mounting surface 13*n* and is positioned on the upstream of the flow path of the injected resin 34 than the partial region 29*p* are smaller than those on the upstream of the flow path of the injected resin 34.

In such a case illustrated in FIG. 19, the effect of the heat of the injected resin 34 on the mounting surface 13*n* and a region in the periphery of the drum frame 13 can be reduced as compared with a case where the configuration according to the present exemplary embodiment is not applied. Therefore, the deformation amount of the drum frame 13 due to the heat held by the injected resin 34 can be reduced. In addition, a cooling time of the resin 34 after injection can be shortened.

Accordingly, the above-described effects can be obtained as long as a thickness, a cross sectional area, or a contact area of at least a part of the region (portion) of the charging roller contact unit 29*b* in the periphery of the mounting surface 13*n* is smaller than that on the upstream of the flow path of the injected resin 34.

According to the present disclosure, the configuration in which the frame is integrally formed with the molten resin injected thereto and the injection part of the molten resin is located in the periphery of the supporting portion of the process unit in the frame can suppress the transfer of the heat of the injected molten resin to the supporting portion of the process unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-194870 filed Sep. 5, 2012, which is hereby incorporated by reference herein in its entirety.

What is claimed is:

1. A cartridge detachably mounted to an apparatus main body of an image forming apparatus, the cartridge comprising:

a frame;

a process unit configured to perform image forming;

a supporting portion disposed on the frame and configured to support the process unit; and an injection member, which has a portion, integrally formed with the frame such that a molten resin is injected from an injection port disposed on the frame, and an area of a cross section of the portion perpendicular to an injection direction approaching from the injection port to a forming portion is formed to become smaller continuously, or in a step-by-step manner, with an approach from the injection port to the forming portion, wherein the injection member is a conductive resin and the cartridge is brought into contact with a main body contact disposed on the apparatus main body in a case where the cartridge is attached to the apparatus main body so the main body contact is electrically connected to the process unit.

2. The cartridge according to claim 1, wherein a projection portion projecting to a region to which the molten resin is injected is provided to the frame so the cross sectional area of the injection member becomes smaller continuously, or in a step-by-step manner, with an approach to the forming portion.

3. The cartridge according to claim 2, wherein the projection portion is extended in the injection direction.

4. The cartridge according to claim 1, wherein the frame includes a regulation portion for preventing the molten resin from contacting the supporting portion when the molten resin is injected to the frame.

5. The cartridge according to claim 1, wherein the injection member is integrally formed with the frame such that the molten resin is injected into a space formed by a mold abutting on the frame and the frame.

6. The cartridge according to claim 1, wherein the process unit is a cleaning member for removing a developer from a surface of a photosensitive member, and the supporting portion is a mounting surface on which the cleaning member is mounted to the frame.

7. The cartridge according to claim 6, further comprising:

a charging roller configured to charge the photosensitive member; and a spring member is in contact with the forming portion and configured to apply a force to the charging roller toward the photosensitive member, wherein the injection member is brought into contact with the main body contact disposed on the apparatus main body in a case where the cartridge is attached to the apparatus main body so the main body contact is electrically connected to the charging roller, and the forming portion is adjacent to the mounting surface of the cleaning member.

8. An image forming apparatus capable of forming an image on a recording medium, the image forming apparatus comprising:

a frame;

a process unit configured to perform image forming;

a supporting portion disposed on the frame and configured to support the process unit; and an injection member, which has a portion, integrally formed with the frame in such a manner that a molten resin is injected from an injection port disposed on the frame, and an area of a cross section of the portion perpendicular to an injection direction approaching from the injection port to the supporting portion is formed to become smaller continuously, or in a step-by-step manner, with an approach from the injection port to the forming portion, wherein the injection member is a conductive resin and is brought into contact with a main body contact disposed on the apparatus main body so the main body contact is electrically connected to the process unit.

9. The image forming apparatus according to claim 8, wherein a projection portion projecting to a region to which the molten resin is injected is provided to the frame so that the cross sectional area of the injection member becomes smaller continuously, or in a step-by-step manner, with an approach to the forming portion.

10. The image forming apparatus according to claim 9, wherein the projection portion is extended in the injection direction.

11. The image forming apparatus according to claim 8, wherein the frame includes a regulation portion for preventing the molten resin from contacting the supporting portion when the molten resin is injected to the frame.

12. The image forming apparatus according to claim 8, wherein the injection member is integrally formed with the frame such that the molten resin is injected into a space formed by a mold abutting on the frame and the frame.

13. The image forming apparatus according to claim 8, wherein the process unit is a cleaning member for removing a developer from a surface of a photosensitive member, and the supporting portion is a mounting surface on which the cleaning member is mounted to the frame.

14. The image forming apparatus according to claim 13, further comprising:

a charging roller configured to charge the photosensitive member; and a spring member is in contact with the forming portion provided to the injection member and configured to apply a force to the charging roller toward the photosensitive member, wherein the injection member is a conductive resin and is brought into contact with the main body contact disposed on the apparatus main body so the main body contact is electrically connected to the charging roller, and the forming portion is adjacent to the mounting surface of the cleaning member.

* * * * *